United States Patent [19]

Wischusen, III

[11] Patent Number: 4,511,042

[45] Date of Patent: Apr. 16, 1985

[54] COMBINATION SNACK FOOD TRAY

[75] Inventor: Henry Wischusen, III, Lilburn, Ga.

[73] Assignee: Rock-Tenn Company, Norcross, Ga.

[21] Appl. No.: 611,931

[22] Filed: May 21, 1984

Related U.S. Application Data

[63] Continuation of Ser. No. 414,952, Sep. 3, 1982, abandoned.

[51] Int. Cl.[3] ..... B65D 5/54

[52] U.S. Cl. ..... 206/611; 206/562; 206/620; 206/628; 229/19; 229/30; 229/41 B

[58] Field of Search ..... 206/561, 611, 612, 628

[56] References Cited

U.S. PATENT DOCUMENTS

| | | | |
|---|---|---|---|
| 1,925,102 | 9/1933 | Levkoff | 206/45.12 |
| 2,238,545 | 4/1941 | Whiley | 206/427 |
| 2,403,840 | 7/1946 | Ashurst | 6/9 |
| 2,604,980 | 7/1952 | Reid | 206/20 |
| 2,663,489 | 12/1953 | Paige | 229/37 R |
| 2,711,819 | 6/1955 | Vander Lugt, Jr. | 206/45.14 |
| 2,732,983 | 1/1956 | Siddall | 224/48 |
| 2,875,940 | 3/1959 | Dunn | 229/30 |
| 3,005,584 | 10/1961 | Coe | 229/41 B X |
| 3,195,719 | 7/1965 | Giesler | 206/47 |
| 3,208,583 | 9/1965 | Kamps | 206/44 R |
| 3,215,332 | 11/1965 | Bess | 229/19 |
| 3,281,054 | 10/1966 | Buttery et al. | 206/612 |
| 3,288,344 | 11/1966 | Woollen et al. | 229/7 |
| 3,322,329 | 5/1967 | Castaneda et al. | 206/620 |
| 3,323,706 | 6/1967 | Gereke | 229/15 |
| 3,348,672 | 10/1967 | Brown | 206/65 |
| 3,349,985 | 10/1967 | Salway | 229/14 |
| 3,376,974 | 4/1968 | Hilliard | 206/72 |
| 3,397,776 | 8/1968 | Weiss | 206/65 |
| 3,398,856 | 8/1968 | Graser | 229/40 X |
| 3,411,696 | 11/1968 | Ayer et al. | 229/40 |
| 3,512,697 | 5/1970 | Robinson | 229/41 B X |
| 3,522,907 | 8/1970 | Utterback, Jr. | 206/628 X |
| 3,587,837 | 6/1971 | Smith | 229/27 X |
| 3,604,560 | 9/1971 | Farquhar | 206/491 |
| 3,618,848 | 11/1971 | Palowski | 206/491 |
| 3,637,130 | 1/1972 | Farquhar | 229/28 R |
| 3,659,707 | 5/1972 | Nilsson et al. | 206/597 |
| 3,669,251 | 3/1972 | Phillips, Jr. | 206/44 R |
| 3,679,122 | 7/1972 | Neff | 229/40 |
| 3,705,681 | 12/1972 | Rossi | 229/40 |
| 3,722,781 | 3/1973 | Page et al. | 229/30 X |
| 3,829,006 | 8/1974 | Spiegel | 206/628 X |
| 3,904,029 | 9/1975 | Koltz | 229/38 |
| 3,907,195 | 9/1975 | Struble | 229/41 B |
| 3,977,518 | 8/1976 | Arneson | 229/40 X |
| 4,000,811 | 1/1977 | Hardison et al. | 206/44 R |
| 4,113,100 | 9/1978 | Soja et al. | 206/602 |
| 4,130,237 | 12/1978 | Struble | 229/40 |
| 4,180,165 | 12/1979 | Kuchenbecker | 206/45.31 X |
| 4,221,320 | 9/1980 | Faller | 229/19 |
| 4,326,356 | 4/1982 | Mason | 446/73 |
| 4,360,107 | 11/1982 | Roccaforte | 206/620 X |

FOREIGN PATENT DOCUMENTS

| | | | |
|---|---|---|---|
| 687951 | 6/1964 | Canada | 206/626 |
| 268988 | 2/1969 | Fed. Rep. of Germany | 229/28 R |
| 1400046 | 4/1965 | France | 206/45.31 |

OTHER PUBLICATIONS

Helmold Catalog 1979, p. 23.

*Primary Examiner*—George E. Lowrance
*Assistant Examiner*—Gary E. Elkins
*Attorney, Agent, or Firm*—Jones & Askew

[57] ABSTRACT

A combination tray for carrying a drink container and a food container includes a tubular enclosure closed at one end by an automatic-type closure. The drink container is inserted through break-away tabs in the top of the tray, and the food container is slid into an open end of the enclosure and protected by a removable tear-away panel. A retaining panel folds into the open end to prevent the food container from sliding out of the enclosure.

4 Claims, 4 Drawing Figures

COMBINATION SNACK FOOD TRAY

This application is a continuation of application Ser. No. 414,952, filed Sept. 3, 1982, now abandoned.

TECHNICAL FIELD

The present invention relates to disposable containers formed from a single sheet of paperboard or the like, and particularly relates to a collapsable tray for holding both a drink container and a food container.

BACKGROUND ART

Many attempts have been made in the food and concessions industry to provide customers with convenient containers in which to carry food and drink from the point of sale to the place where the customer intends to consume the food. In many cases, the food is wrapped, the soft drink cups are capped with plastic snap-on closures, and both are placed in paper sacks. Since paper sacks have no rigidity, this practice leads to a possibility that the drink will leak or that food in open ended containers, such as french fries or popcorn, will fall to the bottom of the sack.

Some more rigid paperboard trays have been developed to provide a better means for transporting the food and drink. In one well known tray, four receptacles for retaining drink cups are provided, two at each end of the tray separated by an open area into which the food can be placed. While representing an improvement over the use of paper sacks, such trays leave exposed food such as popcorn or french fries unprotected. Also, such trays are generally shallow, and are unstable when carried by hand with several drinks in place.

SUMMARY OF THE INVENTION

The present invention solves problems with prior art combination drink and food trays by providing a collapsable tray for holding both a drink container and an additional food container in a manner which provides stability to the drink container and substantially protects the food until eaten.

Generally described, the present invention is a combination tray of paperboard or the like, for receiving a drink container and a food container, comprising a top panel and a bottom panel, held in spaced apart relation by a pair of side panels foldably connected to the top and bottom panels to form a tubular enclosure; flap means for closing one end of the tubular enclosure; the bottom panel defining selectively operable means for preventing the food container from escaping from the other end of the enclosure; and the top panel defining an opening therein adjacent to the closed end of the enclosure for receiving a drink container, and a tear-away panel comprising an area of the top panel between the drink opening and the open end of the enclosure. According to one embodiment of the invention, the food container can be inserted into the enclosure through the open end and retained by folding a retaining panel into the open end of the enclosure. The retaining panel locks in a vertical position when folded into the enclosure so as to prevent any food container from sliding back out of the enclosure. The food container can then be exposed for access by removal of the tear-away panel defined by the top panel of the enclosure.

The concepts of the invention can also be utilized in a tray as described above without the drink container opening.

The flap means for closing one end of the tubular enclosure is preferably a conventional "automatic bottom" closure. Such a structure provides rigidity to the closed end of the container, and permits the container to have a substantial depth in order to accommodate large containers for popcorn and the like, and also to engage the drink container at a point high enough to provide the container with substantial stability and protection against falling out of the tray. The invention has the further advantage that it can be constructed from a single sheet of paperboard or the like which can be folded and glued into a flat configuration for shipping and handling. When the container is to be used, it can be easily popped up into an erected configuration ready to receive food and drink. The combination tray of the invention can be made more economically than some known containers for popcorn alone.

Thus, it is an object of the present invention to provide a tray suitable for carrying and protecting food and the like.

It is a further object of the present invention to provide an improved paperboard tray for carrying both a drink container and a food container.

It is a further object of the present invention to provide a collapsable tray capable of protecting exposed food such as popcorn, and allowing such food to be easily exposed for consumption.

It is a further object of the invention to provide a paperboard tray into which food containers can be loaded easily and retained within the tray.

It is a further object of the invention to provide a combination tray for carrying a hot food item and a cold food item and for separating such items to prevent heat transfer between them.

Other objects, features and advantages of the present invention will become apparent upon reading the following detailed description of an embodiment of the invention, when taken in conjunction with the drawing and the appended claims.

DETAILED DESCRIPTION

Figure 1:
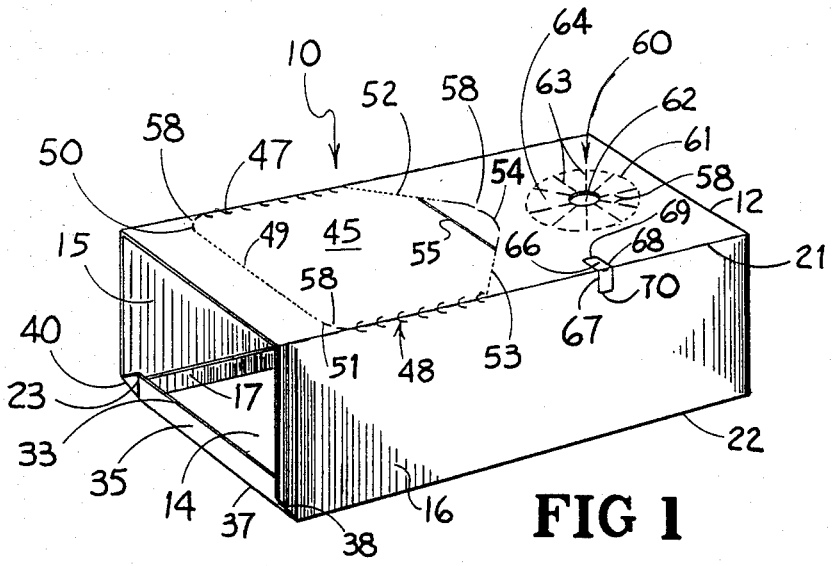
FIG. 1 is a pictorial view of a container embodying the present invention in its erected configuration.

Referring now in more detail to the drawing, in which like reference numerals represent like parts throughout the several views, FIG. 1 shows a container or tray 10 embodying the present invention. The tray 10 is assembled from a paperboard blank 11 cut and scored in the manner shown in FIG. 4. The tray 10 includes a number of longitudinally extending wall panels, a top panel 12, bottom panel 14, side panel 15, side panel 16, and glue flap 17. A series of parallel, jump cut scores, 20, 21, 22 and 23 foldably interconnect, respectively, the side panel 15 to the top panel 12, the top panel 12 to the side panel 16, the side panel 16 to the bottom panel 14, and the bottom panel 14 to the glue flap 17. Referring to FIG. 1, it is seen that the side panels 15 and 16 hold the top and bottom panels in spaced apart relation, the wall panels forming a tubular enclosure when a cut edge 18 of the side wall panel 15 is adhered to the glue panel 17.

Figure 3:
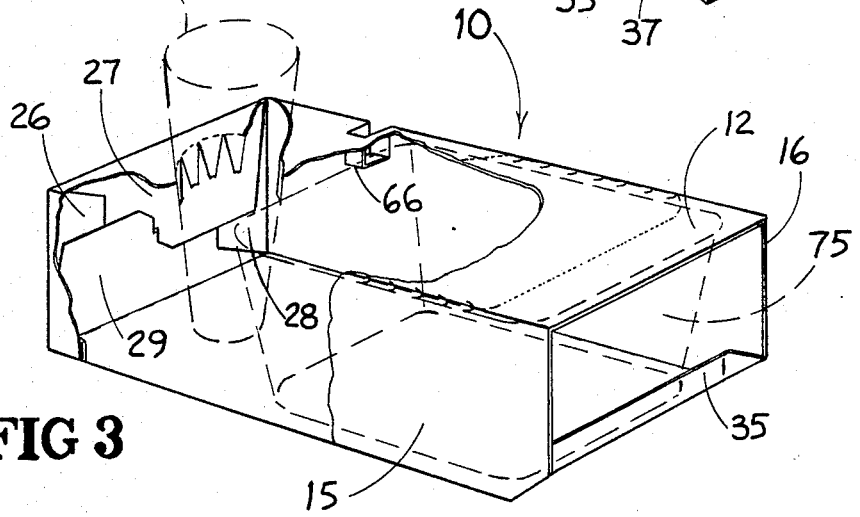
FIG. 3 is a pictorial view of the container shown in FIG. 1 with portions broken away to show interior detail, and showing a food container and a drink container in dashed lines.

The tray 10 includes a closed end indicated generally at 25, which is closed by flap means forming a conventional "automatic bottom" closure. The automatic closure is formed by an end flap 26, foldably connected to side panel 15, an end flap 27 foldably connected to the top panel 12, an end flap 28 foldably connected to side panel 16, an end flap 29 foldably connected to bottom panel 14. When the container 10 is erected, the end flaps 27 and 29 interlock, as shown in FIG. 3, to provide rigidity to the closed end 25 of the tray 10. The tubular enclosure of the tray 10 also defines an open end, generally indicated as 32. The open end 32 is defined by an exposed cut edge 33 comprising cut edges of all of the wall panels 12, 14, 15 and 16.

Figure 2:
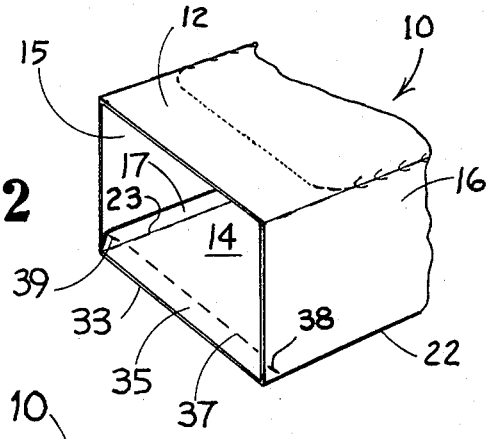
FIG. 2 is a partial view of the open end of the container shown in FIG. 1 showing the retaining panel in a lowered configuration ready for the insertion of food into the container.

A retaining panel 35 is defined by the bottom panel 14 adjacent to the open end 32 of the container 10. A transverse jump cut score 37 extends across the bottom panel 14 parallel to the exposed edge 33 spaced inwardly a short distance from the edge 33. From one end of the score 37 where the score 37 meets the longitudinal score 22, a diagonal score 38 extends across a corner of the side panel 16 to the exposed edge 33. A similar diagonal score 39 extends from the end of the score 37 across the glue flap 17, and another similar diagonal score extends across the corner of the side panel 15 from the exposed edge 18 to the exposed edge 33. It will be seen that when the edge 18 is adhered to the glue flap 17, the diagonal score 40 rests precisely over the score 39. As will be explained in more detail below, the retaining flap 35 has two positions, an open position, as shown in FIG. 2, and a closed or locking position, as shown in FIGS. 1 and 3.

A tear-away panel 45 is defined in the top panel 12. The tear-away panel 45 is defined by a "zipper rule" score 47 extending along the longitudinal score 20 for a portion of its distance, and by a parallel zipper rule score 48 extending along the score 21. Adjacent to the open end 32 of the container 10, the zipper scores 47 and 48 are connected by a 1/32 inch perforation 49 extending transversely across the top panel 12, and a pair of curved cut corners 50 and 51 which connect the zipper score, 47 and 48, respectively, to the perforation 49. At the opposite end of the tear-away panel 45, diagonal perforations 52 and 53 extend from the zipper scores toward the center of the panel 12 where they meet at a break-away tab 54. The tab 54 is defined by a curved cut in the panel 12, the ends of which are connected by a transverse score of 55. The tab 54 can be snapped into the box about the score 55 so that the tear-away panel 45 can be grasped for removal. The cut corners 50 and 51, and the cut forming the break-away tab 54 can include small joining connections 58 at widely spaced intervals. The joining connections 58 are very easily broken when desired, but provide stability before use of the tray.

A drink-receiving means 60 is defined in the top panel 12 between the tear-away panel 45 and the closed end 25 of the container. The drink-receiving means 60 is defined by a circular jump cut score 61 having a diameter selected to be somewhat larger than the appropriate diameter of a drink cup or can which rests upon the bottom panel 14. A concentric opening 62 is cut out within the circular score 61, and the opening 62 is joined to the score 61 by plurality of radial break-away cuts 63. Each break-away cut 63 includes one joining connection 58 midway along its length. When a drink container is inserted downwardly through the top panel 12, the connections 58 give way easily, allowing tabs 64 defined by the break-away cuts 63 to fold down into the container 10.

The circular score 61 is positioned closely adjacent to the closed end 25.

A stop panel 66 is defined by the top panel 12 and the side panel 16. Parallel transverse cuts 67 and 68 span the score 21 and are connected at their ends by a score 69 in the top panel 12, and a score 70 in the side panel 16. After the tray 10 has been erected, the stop panel 66 can be popped into the container 10, as shown in FIG. 3. In such configuration, it will prevent a suitably sized food container from sliding too far into the tray 10. The stop panel 66 maintains a space between the drink container and the food container. If either the drink or the food is hot or cold, the air space between them and the tabs 64 help to prevent heat transfer.

Figure 4:
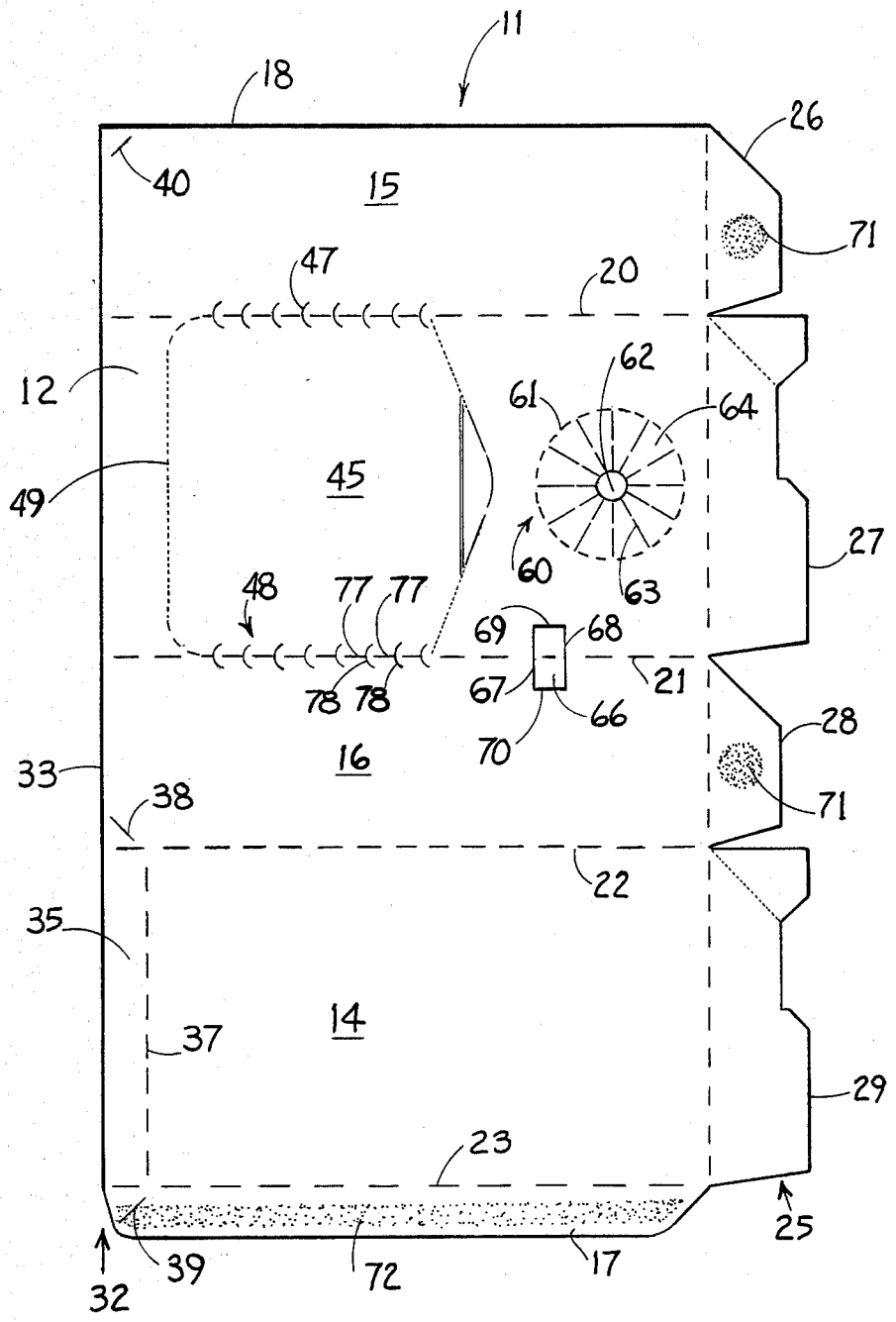
FIG. 4 is a top plan view of a paperboard blank from which the container of FIG. 1 is assembled.

In order to assemble the tray 10, the end flaps 26–29 are folded downwardly from their position in FIG. 4 against the back of the blank 11 in the conventional manner for forming an "automatic" closure. Glue spots 71 are applied to the end flaps 26 and 28. A bead of glue 72 is applied to the upper surface of the glue flap 17 along its length. The blank is then folded about the score 22 and then about the score 20, to adhere the edge 18 of the side panel 15 to the glue flap 17, and at the same time, the end flaps 27 and 29 to the flaps 26 and 28, respectively. The tray 10 is now assembled for shipping and handling in a flat configuration. When a user desires to erect the container 10 for use, pressure is simply applied inwardly to the scores 20 and 22. This will cause the flaps 27 and 29 of the end closure to slide past one another and lock themselves together in a well known manner. The erected end configuration is shown in FIG. 3. The stop flap 66 is then popped into the container, also as shown in FIG. 3. A popcorn tub 75, shown in dashed lines, can then be slid through the open end 32 of the container 10 until it engages the stop 66. Then, the retaining flap 35 is folded into the open end of the tray 10 about the scores 37, 38 and 39/40. Because of the configuration of these scores, the retaining flap 35 locks in its erected position, and therefore will prevent the popcorn tub 75 from sliding out of the tray 10. A drink cup 74, also shown in dashed lines in FIG. 3, can be inserted into the container by placing the cup 74 over the drink-receiving means 60 and exerting downward pressure. Such pressure will separate the tabs 64 and allow the cup 74 to be lowered until it rests upon the bottom panel 14. The tabs tabs 64 press against the sides of the cup 74 to provide stability.

In the configuration described, the combination tray 10 of the present invention can be used to carry the food and drink from place to place while protecting exposed food in the container 75 and providing stable retention of the drink container 74 to prevent spilling or leaking. When the user desires to eat the food, a finger is placed upon the break-away tab 54, and the tab 54 is folded into the tray 10 and against the lower side of the tear away panel 45. This allows the user to grasp the panel 45 and to pull upwardly on the panel 45. The perforations 52 and 53 give way, and then the panel 45 is torn away along the zipper scores 47 and 48. Finally, a transverse pull on the panel 45 tears the panel away along the perforation 49, exposing the food in the container 75. The drink container 74 can be removed for drinking simply by lifting it vertically out of the opening defined by the drink-receiving means 60. Of course, the cup 74 can be replaced into the means 60. A soft drink or beer can could also be utilized in the same fashion.

It will be seen that the automatic bottom type closure at the closed end of the tray 10 provides a rigid structure which permits the tray 10 to have a greater depth that has typically been the case with prior art trays. Thus, a larger food container 75 can be inserted into the tray 10, and the drink container inserted into the opening 60 is supported both at its base by the bottom panel 14 and at a point relatively high along its height by the top panel 12. There is little danger of the drink overturning or falling out of the tray if the user is jostled in a crowd. The retaining panel 35 provides a convenient way for keeping the food container 75 in the tray 10 without requiring a complicated closure mechanism for closing the entire end of the tray. The stop 66 prevents the food container 75 from being inserted too far, in which case it might be in the path of the drink container 74, if the latter is inserted after the food container 75.

The zipper scores 47 and 48 are specifically designed to prevent tearing into or separation of the side panels 15 and 16. To accomplish this result, the zipper scores 47 and 48 comprise a series of jump cuts 77 as shown in FIG. 4, and a corresponding series of semi-circular cuts 78. The semi-circular cuts 78 join one end of each of the jump cuts 78 at the center of the semi-circular cut 78. The ends of the semi-circular cuts 78 extend to be even along a transverse line with the adjacent end of the next jump cut 77. Thus, if the paperboard tends to tear transversely from the end of a jump cut 77, the tear will meet one of the semi-circular cuts 78 and be directed back along the next jump cut 77. This configuration solves a problem in prior zipper scores, which had a tendency to tear transversely into an adjacent panel, sometimes causing a separation or splitting of the panel.

The concept of the present invention relating to the protection and exposure of the food container 75 can be embodied in a container which does not provide means for receiving a drink container. Such a container would simply not require the drink receiving means 60, nor the stop 66. In other respects, a preferred embodiment of such container would be constructed as described above and shown in the drawing.

While this invention has been described in detail with regard to a preferred embodiment thereof, it should be understood that variations and modifications can be made without departing from the spirit and scope of the invention as defined in the following claims.

I claim:

1. A tray of paperboard or the like, for receiving a drink container and a food container, comprising:

a top panel and a bottom panel, held in spaced apart relation by a pair of side panels foldably connected along linear scores to said top and bottom panels, a glue flap extending from said bottom panel and being adhered to the adjacent side panel, said panels and glue flap forming a collapsible tubular enclosure having a substantially open interior, said enclosure having first and second ends each defined by coplanar edges of said top, bottom and side panels;

said first end being closed by automatic end closure flaps extending from said edges of said top, bottom and side panels;

said second end being substantially open and comprising a retaining panel defined in said bottom panel by a transverse score spaced inwardly from the coplanar edge of said bottom panel and extending between said side panels, said side panels each defining a diagonal score extending from an end of said transverse score to meet the coplanar edge of said side panel intermediate the foldably connected edges thereof, and said glue flap defining a diagonal score matching the diagonal score of the side panel to which said glue flap is adhered;

drink-receiving means defining in said top panel adjacent to said first end, for receiving a drink container, comprising a circular score and a plurality of radial break-away cuts extending from said circular score essentially to the center of said circular score, said drink-receiving means substantially enclosing the area within said circular score; and a tear-away panel comprising an area of said top panel between said circular score and said second end, said tear-away panel being defined by parallel zipper rules extending along the foldable connections between said top panel and said side panels, a first transverse line of perforation extending across said top panel adjacent to said second end to join said zipper rules, and a second transverse line of perforation extending across said top panel adjacent to said circular score to join said zipper rules;

said second transverse line of perforation defining intermediate the ends thereof a tab connected to said tear-away panel by a transverse fold line, said tab being foldable into said enclosure to enable grasping of said tear-away panel;

said zipper rules comprising a plurality of spaced apart linear cut scores defining a path of tearing, and a plurality of semi-circular cut scores, each semi-circular cut score intersecting an end of one of said linear cut scores intermediate the ends of said semi-circular score, and extending such that both ends of said semi-circular score intersect a line drawn normal to the near end of the next adjacent linear cut score;

whereby said food container can be inserted into said enclosure through the open second end thereof, retained by folding said retaining panel into the open end, and protected by said top panel until being exposed by removal of said tear-away panel, and whereby said drink-deceiving means protects said food container prior to insertion of said drink container therein.

2. The tray of claim 1, further comprising stop means between said drink-receiving opening and said tear-away panel for limiting insertion of said food container into said enclosure.

3. The tray of claim 2, wherein said stop means comprises an L-shaped panel defined by two parallel cuts spanning a foldable connection between a side panel and one of said top panel and said bottom panel.

4. The tray of claim 1, further comprising an opening concentric with and within said circular score.

* * * * *